US011371535B2

(12) United States Patent
Shimada

(10) Patent No.: US 11,371,535 B2
(45) Date of Patent: Jun. 28, 2022

(54) FLUID PRESSURE CIRCUIT

(71) Applicant: EAGLE INDUSTRY CO., LTD., Tokyo (JP)

(72) Inventor: Yoshiyuki Shimada, Tokyo (JP)

(73) Assignee: EAGLE INDUSTRY CO., LTD.

( * ) Notice: Subject to any disclaimer, the term of this patent is extended or adjusted under 35 U.S.C. 154(b) by 0 days.

(21) Appl. No.: 16/981,498

(22) PCT Filed: Apr. 3, 2019

(86) PCT No.: PCT/JP2019/014728
§ 371 (c)(1),
(2) Date: Sep. 16, 2020

(87) PCT Pub. No.: WO2019/198579
PCT Pub. Date: Oct. 17, 2019

(65) Prior Publication Data

US 2021/0364015 A1 Nov. 25, 2021

(30) Foreign Application Priority Data

Apr. 9, 2018 (JP) ..... JP2018-074578

(51) Int. Cl.
*F15B 1/027* (2006.01)
*F15B 15/20* (2006.01)

(52) U.S. Cl.
CPC ..... *F15B 1/027* (2013.01); *F15B 15/20* (2013.01)

(58) Field of Classification Search
CPC ..... F15B 1/027; F15B 1/033; F15B 21/14; F15B 2211/20538; F15B 2211/212; F15B 2211/413; E02F 9/2217
See application file for complete search history.

(56) References Cited

U.S. PATENT DOCUMENTS 3,802,453 A * 4/1974 Fleury ..... B60T 13/141 137/85
4,688,380 A 8/1987 Reinhardt et al.
(Continued)

FOREIGN PATENT DOCUMENTS

JP 59006403 A * 1/1984 ..... F15B 11/16
JP S62-46002 2/1987 ..... F15B 11/02
(Continued)

OTHER PUBLICATIONS

International Search Report and Written Opinion issued in PCT/JP2019/014728, dated Jul. 2, 2019, with English translation, 19 pages.
(Continued)

*Primary Examiner* — Thomas E Lazo
(74) *Attorney, Agent, or Firm* — Hayes Soloway P.C.

(57) ABSTRACT

A fluid pressure circuit includes a directional switching valve arranged between a fixed displacement pump and a fluid pressure actuator and configured to switch a flow passage for a pressurized fluid, an accumulator arranged in a branch flow passage branched from a connection flow passage that connects the fluid pressure actuator and the directional switching valve, an accumulator flow control valve arranged between the connection flow passage and the accumulator, and a pump flow control valve arranged between the fluid pressure actuator and the fixed displacement pump and configured to variably divert a flow rate of the pressurized fluid discharged from the fixed displacement pump into a first system including the tank and a second system including the fluid pressure actuator.

19 Claims, 8 Drawing Sheets

(56) References Cited

U.S. PATENT DOCUMENTS

| | | | | |
|---|---|---|---|---|
| 5,355,773 | A * | 10/1994 | Winkels | F15B 11/02 60/460 |
| 6,772,671 | B2 * | 8/2004 | Asano | E02F 9/2232 91/363 R |
| 6,951,103 | B2 * | 10/2005 | Berthod | E02F 9/2207 60/413 |
| 7,337,610 | B2 * | 3/2008 | Bitter | E02F 9/2207 60/413 |
| 2006/0223670 | A1 | 10/2006 | Nishikawa et al. | |
| 2014/0238007 | A1 * | 8/2014 | Payne | F15B 1/027 60/327 |
| 2018/0087243 | A1 * | 3/2018 | Ito | F15B 21/14 |

FOREIGN PATENT DOCUMENTS

| | | | | |
|---|---|---|---|---|
| JP | 2005-308126 | | 11/2005 | F15B 11/02 |
| JP | 2006-308077 | | 11/2006 | F16H 57/02 |
| JP | 2008-89024 | | 4/2008 | F15B 21/14 |
| JP | 2008-95788 | | 4/2008 | F15B 21/14 |
| JP | 2008089024 | A * | 4/2008 | F15B 1/021 |
| JP | 2017-15130 | | 1/2017 | F15B 21/14 |
| WO | WO-2008088044 | A1 * | 7/2008 | F15B 1/021 |

OTHER PUBLICATIONS

International Preliminary Report on Patentability issued in PCT/JP2019/014728, dated Oct. 13, 2020, 6 pages.

European Search Report issued in related EP Application Serial No. 19785881.4, dated Dec. 3, 2021, 10 pages.

* cited by examiner

Fig. 8

| | $P_Z \geqq P_H$ | $P_H > P_Z \geqq P_L$ | $P_Z < P_L$ |
|---|---|---|---|
| $P_{XZ}$ | $P_X$ | $P_Z$ | – |

FLUID PRESSURE CIRCUIT

TECHNICAL FIELD

The present invention relates to a fluid pressure circuit that controls a fluid pressure actuator according to an operation command.

BACKGROUND ART

A fluid pressure circuit that drives a fluid pressure pump according to an operation command to control a fluid pressure actuator such as a cylinder device is generally used in a work machine, a construction machine, a cargo handling vehicle, an automobile, and the like. As a fluid supply source suitable for the fluid pressure circuit, a fixed displacement fluid pressure pump has been frequently used in the fluid pressure circuit due to its simple structure and excellent maintainability. Further, there is a fluid pressure circuit in which the fluid discharged from a cylinder device is accumulated in an accumulator to effectively utilize energy.

For example, in a hydraulic circuit described in Patent Document 1, when an operating lever of an operating valve is operated in an extending direction, a directional switching valve is switched to an extended position, and pressure oil discharged from a fixed displacement hydraulic pump is introduced into a bottom chamber of a cylinder device to extend a rod outside, and on the other hand, when the operating lever is operated in a retracting direction, the directional switching valve is switched to a retracted position, and the pressure oil discharged from the fixed displacement hydraulic pump is introduced into a rod chamber to retract the rod into the cylinder device.

Further, a branch oil passage is branched from and connected to an oil passage connecting the directional switching valve and the tank. When the rod is retracted, the switching valve is brought into a pressure accumulation position such that part of the return oil discharged from the bottom chamber through the branched oil passage can be accumulated in an accumulator. The pressure oil accumulated in the accumulator is supplied to a regeneration pump motor to generate electricity, such that the energy is utilized effectively.

CITATION LIST

Patent Literature

Patent Citation 1: JP 2008-95788 A (paragraphs 0014 to 0015, FIG. 2)

SUMMARY OF INVENTION

Technical Problem

Here, in the hydraulic circuit described above, part of the oil discharged from the bottom chamber of the cylinder device is accumulated in the accumulator to be used, so that the energy use efficiency is high. Unfortunately, an impact is likely to occur when the directional switching valve is switched, because the fixed displacement hydraulic pump has a constant discharge amount.

The present invention has been made in order to solve the problems described above, and its object is to provide, at a low cost, a fluid pressure circuit capable of smoothly controlling a fluid pressure actuator according to an operation command and capable of effectively utilizing energy.

Solution to Problem

In order to solve the above problem, a fluid pressure circuit according to the present invention includes: a tank having a fluid stored therein; a fixed displacement pump configured to pressurize the fluid in the tank to generate a pressurized fluid; a fluid pressure actuator configured to be driven by the pressurized fluid discharged from the fixed displacement pump and to be controlled in accordance with an operation command; a directional switching valve arranged between the fixed displacement pump and the fluid pressure actuator and configured to switch flow passages for the pressurized fluid; an accumulator arranged in a branch flow passage branched from a connection flow passage that connects the fluid pressure actuator and the directional switching valve; an accumulator flow control valve arranged in the branch flow passage between the connection flow passage and the accumulator; and a pump flow control valve arranged between the fluid pressure actuator and the fixed displacement pump and configured to variably divert a flow rate of the pressurized fluid supplied from the fixed displacement pump into two systems consisting of a first system including the tank and a second system including the fluid pressure actuator. According to the feature, since the pump flow control valve variably outputs the flow rate of the input pressurized fluid to the two systems while using the fixed displacement pump having a simple structure, the fluid pressure actuator can be smoothly controlled according to the operation command, and the fluid pressure actuator can be driven by the fluid accumulated in the accumulator, so that energy can be effectively utilized. Further, the fluid pressure circuit mainly includes the fixed displacement pump, the directional switching valve, the accumulator flow control valve, and the pump flow switching valve, and therefore can be provided at a low cost.

It is preferable that the pump flow control valve may be a spool valve. According to this configuration, since the flow rate can be adjusted by controlling the stroke of the spool, the structure is simple.

It is preferable that the fluid pressure circuit may include a control unit configured to relevantly control the pump flow control valve when the fluid pressure actuator is operated by the accumulator. According to this configuration, the fluid pressure actuator can be smoothly controlled and the load of the fixed displacement pump during the regeneration operation can be reduced.

It is preferable that the accumulator flow control valve may be a proportional valve configured to variably control a flow rate, and the control unit may output a complementary operation command to the accumulator flow control valve and the pump flow control valve. According to this configuration, the characteristics of the operation of the fluid pressure actuator with respect to the operation command during normal control can coincide with that during regeneration control.

It is preferable that the fluid pressure circuit may further includes a pressure sensor configured to detect a pressure of the fluid in the accumulator. According to this configuration, since an actual pressure of the fluid accumulated in the accumulator can be reflected, the control can be performed more smoothly.

It is preferable that the pump flow control valve may be arranged between the directional switching valve and the fixed displacement pump. According to this configuration, since the pump flow control valve is separate from the directional switching valve, the structure of the directional switching valve is not complicated.

BRIEF DESCRIPTION OF DRAWINGS

FIG. 8 is a table for explaining control parameters according to a pressure Pz of an accumulator in the first embodiment.

DESCRIPTION OF EMBODIMENTS

Figure 1:
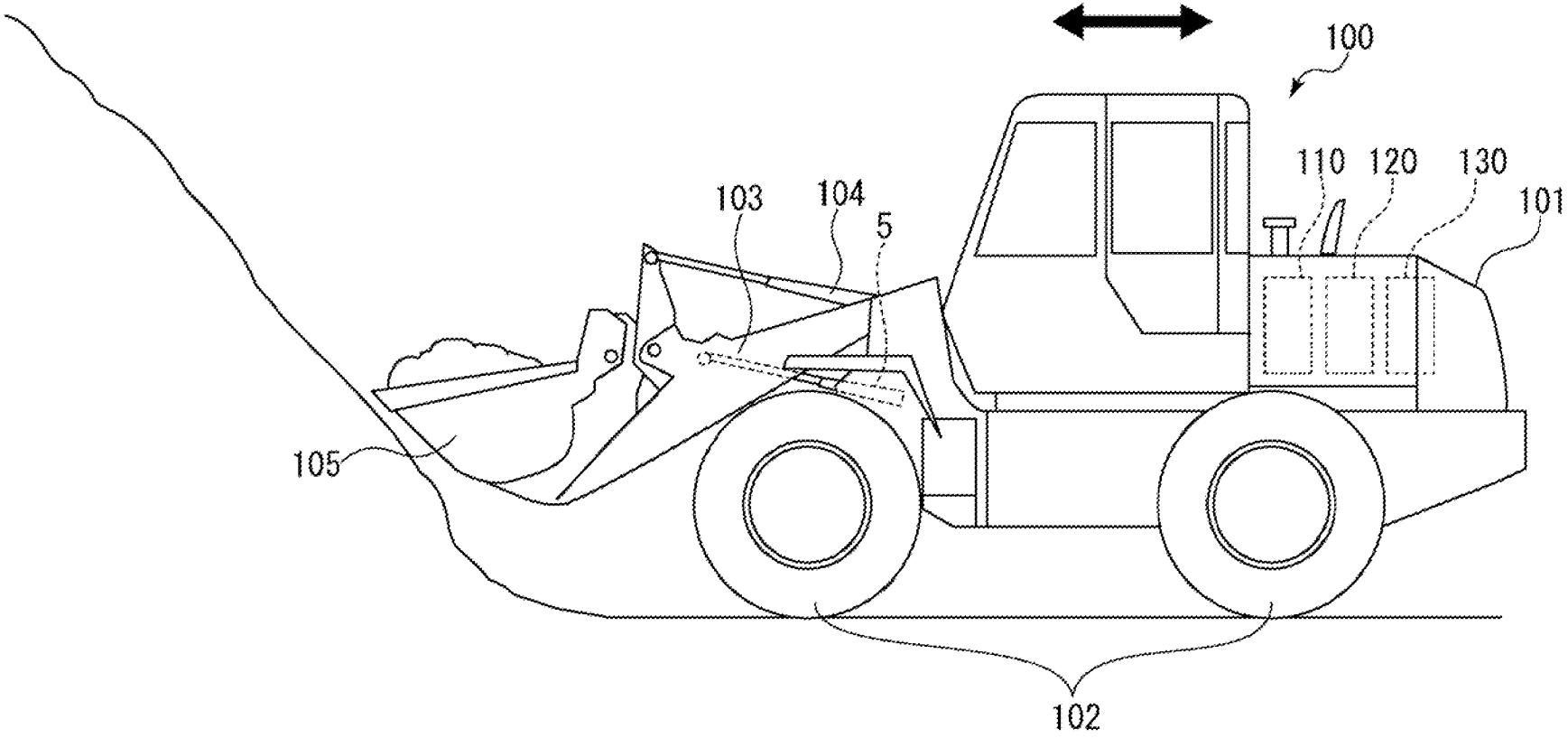
FIG. 1 is a view showing a wheel loader incorporating a hydraulic circuit according to a first embodiment of the present invention.

Modes for implementing a fluid pressure circuit according to the present invention will be described below based on embodiments.

First Embodiment

A hydraulic circuit 130 as a fluid pressure circuit according to a first embodiment of the present invention will be described with reference to FIGS. 1 to 8. A hydraulic circuit as the fluid pressure circuit according to the first embodiment is a hydraulic circuit that controls a stroke of a cylinder device according to an operation command in a work machine, a construction machine, a cargo handling vehicle, an automobile, and the like, and is incorporated in, for example, a power train of a wheel loader 100 shown in FIG. 1. The wheel loader 100 mainly includes a vehicle body 101, drive wheels 102, a working arm 103, a hydraulic cylinder 104, and a bucket 105 in which gravel or the like is loaded. The vehicle body 101 is provided with a machine 110 such as an engine, a drive fluid circuit 120, the hydraulic cylinder 104, and the working hydraulic circuit 130 for driving a hydraulic cylinder 5, which is a cylinder device, etc.

Figure 2:
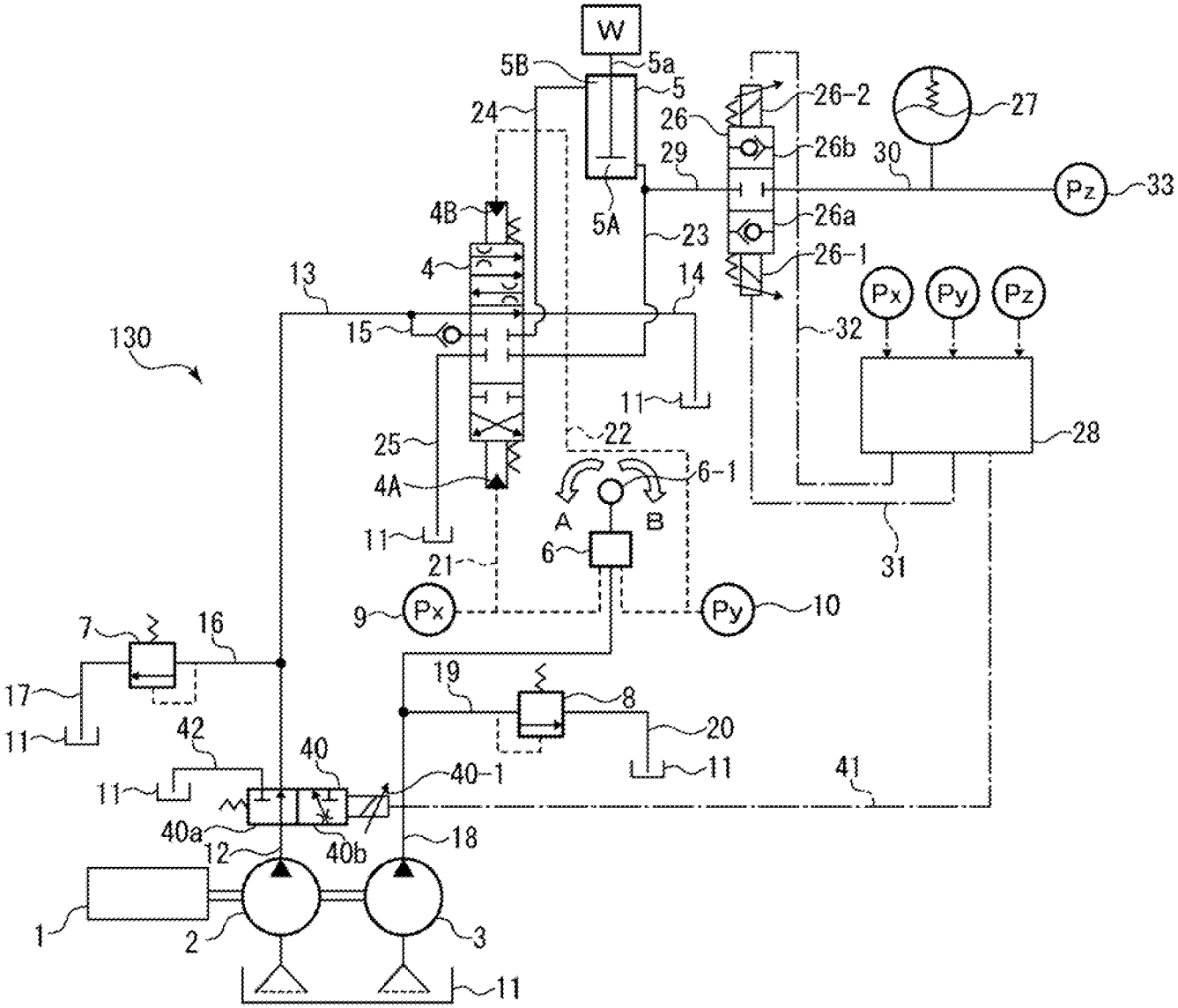
FIG. 2 is a view showing a hydraulic circuit according to the first embodiment.

As shown in FIG. 2, the hydraulic circuit 130 mainly includes a main hydraulic pump 2 as a pump of fixed displacement type or a fixed displacement pump configured to be driven by a drive mechanism 1 such as an engine or an electric motor, a pilot hydraulic pump 3, and a directional switching valve 4, the hydraulic cylinder 5 as a fluid pressure actuator, a tank 11, an electromagnetic proportional flow control valve 26 as an accumulator flow control valve for an accumulator 27, the accumulator 27, a controller 28, a pressure sensor 33, and an electromagnetic proportional flow control valve 40 as a pump flow control valve for the main hydraulic pump 2.

The main hydraulic pump 2 is connected to the drive mechanism 1 such as an internal combustion engine, and is driven to rotate by power from the drive mechanism 1 to supply pressure oil downstream through an oil passage 12.

The pressure oil discharged from the main hydraulic pump 2 flows through the oil passage 12 and an oil passage 13 into the directional switching valve 4. The directional switching valve 4 is a six-port three-position type open center switching valve. In a state where a spool is in a neutral position, the entire amount of pressure oil discharged from the main hydraulic pump 2 flows through an oil passage 14 into the tank 11.

Further, a relief valve 7 is arranged in a main circuit including the main hydraulic pump 2 in order to prevent an oil machine in the circuit from being damaged when a rod 5*a* of the hydraulic cylinder 5 has reached an extension end or a retraction end, or when a load is suddenly applied to the hydraulic cylinder 5, and therefore the inside of the circuit has an abnormally high pressure. The high-pressure oil discharged from the relief valve 7 is allowed to be discharged through the oil passage 17 to the tank 11.

The pilot hydraulic pump 3 is connected to the drive mechanism 1 in the same way as the main hydraulic pump 2 and is driven to rotate by the power from the drive mechanism 1 to supply pressure oil through an oil passage 18 to a remote control valve 6 located downstream.

Further, a relief valve 8 is arranged in a pilot circuit including the pilot hydraulic pump 3, and when the remote control valve 6 is in a neutral position where an operating lever 6-1 is not operated, the pressure oil is discharged through oil passages 19, 20 and the relief valve 8 to the tank 11.

Figure 3:
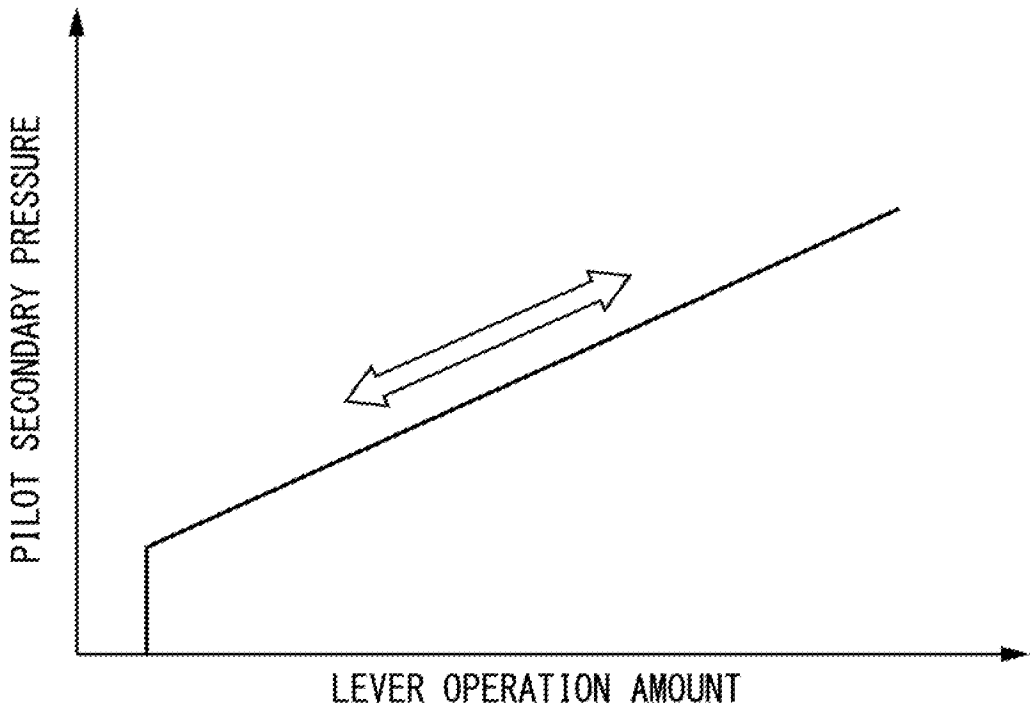
FIG. 3 is a graph showing a relationship between a lever operation amount and a pilot secondary pressure in the first embodiment.

The remote control valve 6 is a variable pressure reducing valve. When the operating lever 6-1 is operated back and forth, the pressure oil at a secondary pressure, which increases in proportion to the lever operation amount as shown in FIG. 3, is supplied through signal oil passages 21 and 22 to signal ports 4A and 4B of the directional switching valve 4. Thus, the directional switching valve 4 is switched to an "extended" or "retracted" position of the hydraulic cylinder 5.

The electromagnetic proportional flow control valve 26 is a two-port three-position type normally closed electromagnetic proportional flow control valve, and incorporates, at an input position 26*a*, a check valve which allows only the flow toward the accumulator 27 and, at an output position 26*b*, a check valve which allows only the flow toward the hydraulic cylinder 5.

The electromagnetic proportional flow control valve 40 is a three-port two-position type normally open electromagnetic proportional flow control valve, and is a spool valve that variably diverts the pressure oil discharged from the main hydraulic pump 2 to the oil passage 12 into two systems, the oil passage 13 and an oil passage 42. The electromagnetic proportional flow control valve 40 has opening characteristics shown in FIG. 5, and communicates the oil passage 12 and the oil passage 13 and closes the oil passage 42 when the valve is in a neutral position 40*a*. When an electric signal from the controller 28 is input to a solenoid unit 40-1 via an electric signal line 41, the electromagnetic proportional flow control valve 40 is variably and gradually switched to a switching position 40*b* according to the amount of change in electric signal, for example, electric energy. When the amount of change becomes equal to or more than a predetermined amount, the electromagnetic proportional flow control valve 40 is completely switched to the switching position 40*b*, the oil passage 12 and the oil passage 13 are closed, and the oil passage 12 is communicated with the tank 11 via the oil passage 42.

(1) Normal Extension Operation Will be Described.

Figure 4:
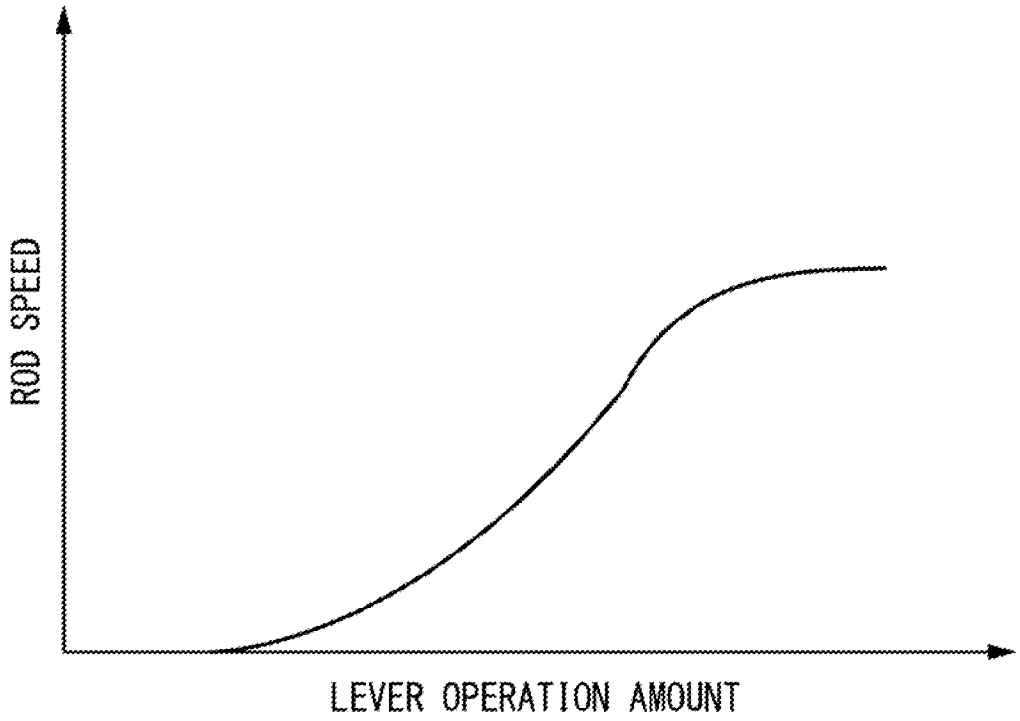
FIG. 4 is a graph showing a relationship between a lever operation amount and a rod speed in the first embodiment.
Figure 5:
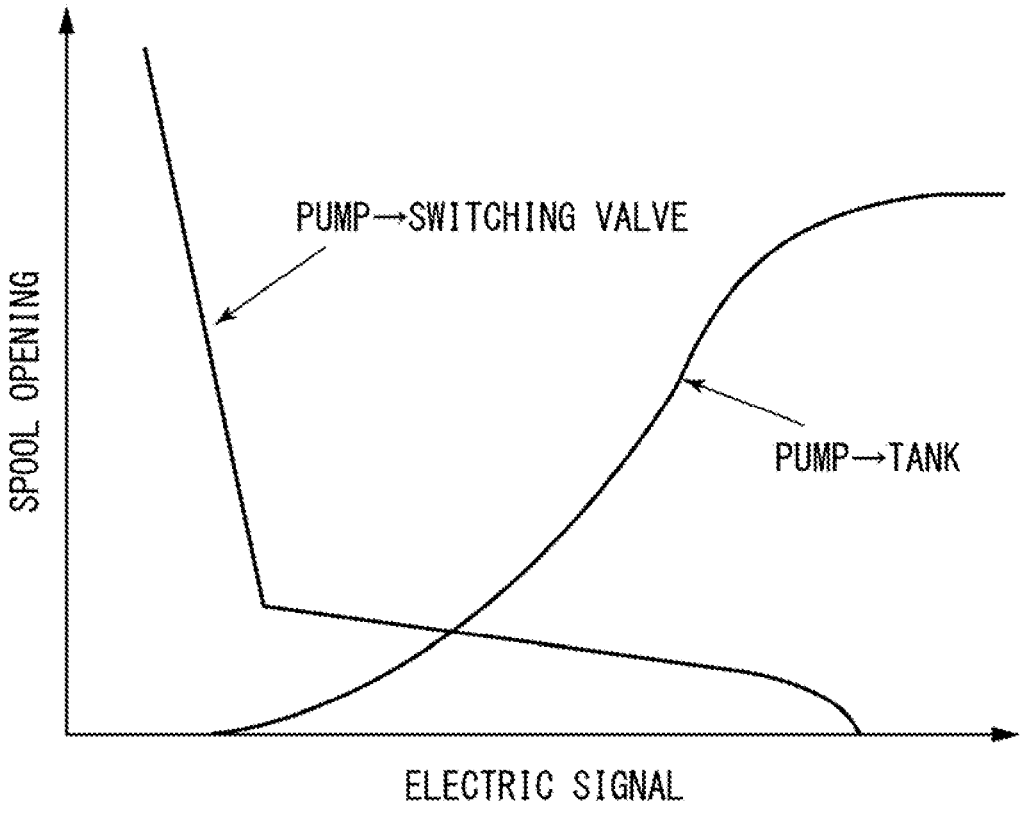
FIG. 5 is a graph showing a relationship between an electric signal and a spool opening of a pump flow control valve in the first embodiment.

The relationship between the amount of operation of the operation lever 6-1 and the extension speed of the rod of the hydraulic cylinder 5 when the lever 6-1 is operated in an extending direction A has a characteristics curve as shown in FIG. 4. The directional switching valve 4 is configured such that the spool strokes substantially in proportion to a pilot secondary pressure of the remote control valve 6, and the valve has opening characteristics in which the amount of opening increases in accordance with the spool stroke. Accordingly, as the amount of opening increases, the amount of pressure oil supplied to the hydraulic cylinder 5 increases, and therefore the operation speed of the rod 5*a* of the hydraulic cylinder 5 increases. That is, the rod speed can be controlled according to the amount of operation of the operating lever 6-1.

When the operating lever 6-1 is operated in the extending direction A to switch the directional switching valve 4 to an extended position, the pressure oil from the main hydraulic pump 2 flows through the oil passages 12, 13, 15, and 23 to a bottom chamber 5A of the hydraulic cylinder 5, and the oil in a rod chamber 5B flows through an oil passage 24 and is then discharged via the directional switching valve 4 through an oil passage 25 to the tank 11. Thus, the rod 5*a* of the hydraulic cylinder 5 moves in an extending direction.

(2) Normal Retraction Operation Will be Described.

When the operating lever 6-1 is operated in a retracting direction B to switch the directional switching valve 4 to a retracted position, the pressure oil from the main hydraulic pump 2 flows through the oil passages 12, 13, 15, and 24 to the rod chamber 5B of the hydraulic cylinder 5, and the oil in the bottom chamber 5A flows through the oil passage 23 as a connection flow passage, and is then discharged via the directional switching valve 4 through the oil passage 25 to the tank 11. Thus, the rod 5*a* of the hydraulic cylinder 5 moves in a retracting direction.

(3) Retraction Operation Involving Pressure Accumulation Will be Described.

When the operating lever 6-1 of the remote control valve 6 is operated in the retracting direction B, the controller 28 determines that the pressure accumulation in the accumulator 27 is possible if the pressure in the accumulator 27 is less than a predetermined high value $P_H$, and performs the following operation. If the pressure in the accumulator 27 is equal to or more than the predetermined high value $P_H$, the controller 28 determines that the pressure accumulation is unnecessary, and does not perform the pressure accumulation.

Figure 6:
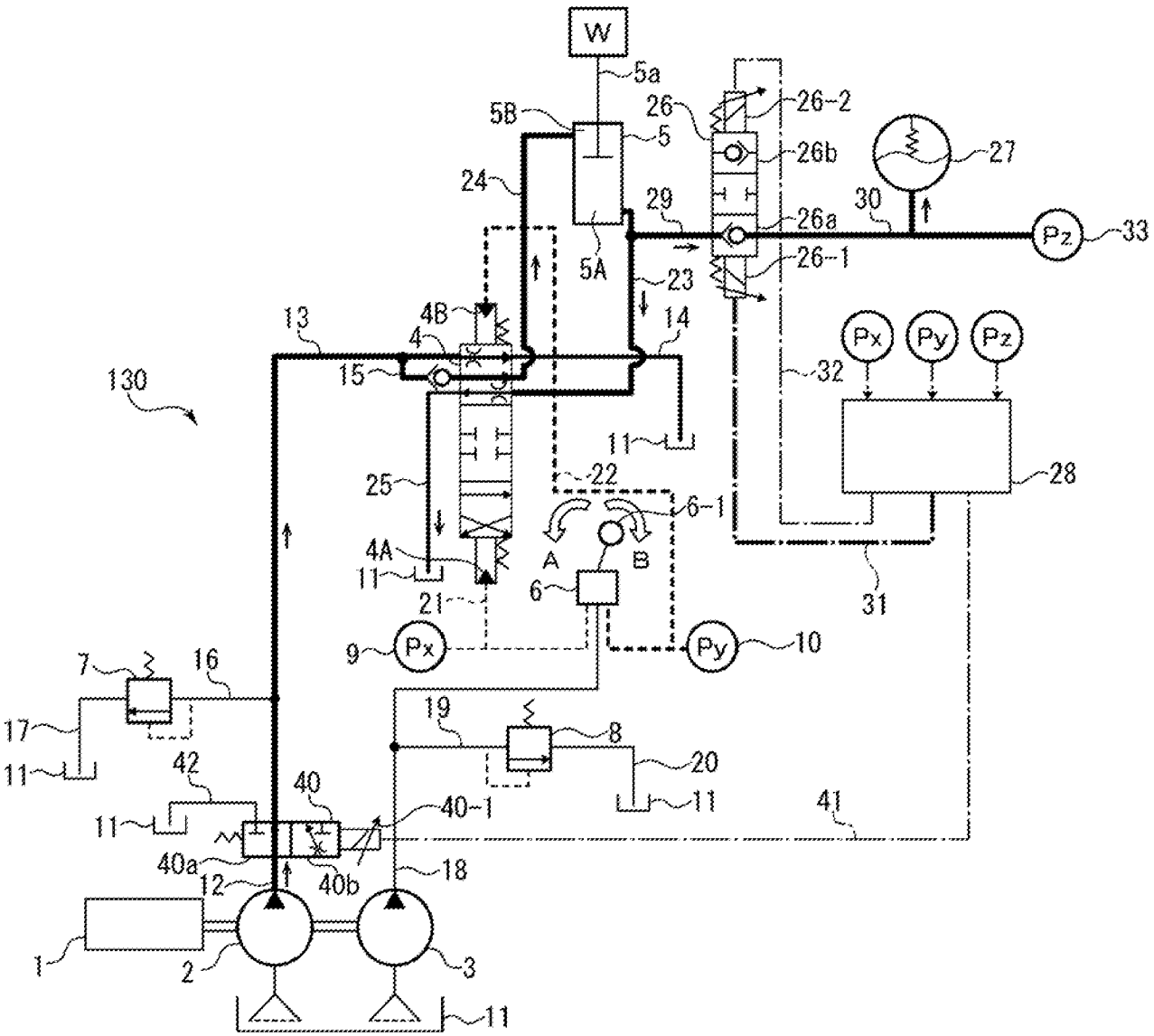
FIG. 6 is a view for explaining a pressure accumulation state in the first embodiment.

Referring to FIG. 6, when the operating lever 6-1 of the remote control valve 6 is operated in the retracting direction B to switch the directional switching valve 4 to the retracted position, the pressure oil from the main hydraulic pump 2 flows through the oil passages 12, 13, an oil passage of the directional switching valve 4, and the oil passage 24 into the rod chamber 5B of the hydraulic cylinder, and the oil in the bottom chamber 5A flows through the oil passage 23 and is discharged via a throttle flow passage of the directional switching valve 4 through the oil passage 25 to the tank 11.

At this time, when an electric signal corresponding to a pressure Py from a pressure sensor 10 arranged in a pilot signal oil passage 22 is input to the controller 28, an electric signal Sy corresponding to the pressure Py is input to the electromagnetic proportional flow control valve 26 through an electric signal line by an arithmetic circuit preliminary integrated in the controller 28. The electromagnetic proportional flow control valve 26 is gradually switched to a side of the input position 26*a* according to the amount of change in electric signal Sy, and part of the oil discharged from the bottom chamber 5A flows through an oil passage 29 as a branch flow passage, the check valve of the electromagnetic proportional flow control valve 26, and an oil passage 30 as a branch flow passage, and is then accumulated in the accumulator 27. When the retraction operation of the rod 5*a* is completed, the controller 28 stops outputting the electric signal to the electric signal line 31, and the electromagnetic proportional flow control valve 26 is brought into the neutral position shown in FIG. 2.

(4) Extension Operation by Regeneration Will be Described.

When the operating lever 6-1 of the remote control valve 6 is operated in the extending direction A, the controller 28 determines that the pressure oil accumulated in the accumulator 27 can be regenerated if the pressure in the accumulator 27 is equal to or more than a predetermined low value $P_L$, and performs the following operation. If the pressure in the accumulator 27 is less than the predetermined low value $P_L$, the regeneration is not performed. The predetermined high value $P_H$ is a pressure higher than the predetermined low value $P_L$.

Figure 7:
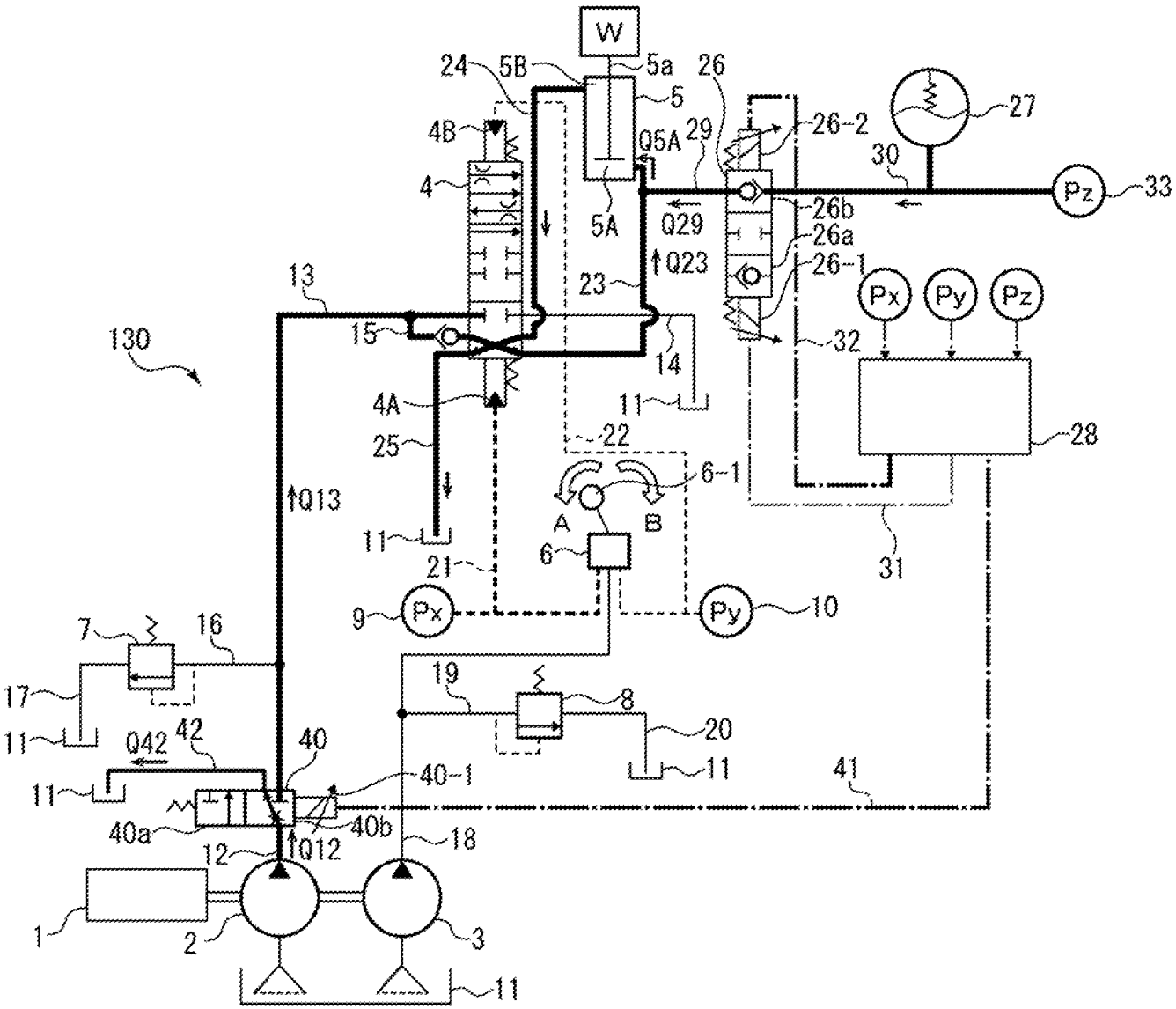
FIG. 7 is a view for explaining a regeneration state in the first embodiment.

Referring to FIG. 7, when the operating lever 6-1 of the remote control valve 6 is operated in the extending direction A to switch the directional switching valve 4 to the extended position, the pressure oil from the main hydraulic pump 2 flows through the oil passages 12, 13, and 15, an oil passage of the directional switching valve 4, and the oil passage 23 into the bottom chamber 5A of the hydraulic cylinder, and the oil in the rod chamber 5B flows through the oil passage 24 and is discharged via an oil passage of the directional switching valve 4 through the oil passage 25 to the tank 11.

At this time, when an electric signal corresponding to a pressure Px from a pressure sensor 9 and an electric signal corresponding to a pressure Pz from the pressure sensor 33 are input to the controller 28, an electric signal Pxz corresponding to the pressures Px and Pz is input to the electromagnetic proportional flow control valve 26 through the electric signal line 32 by the arithmetic circuit preliminarily integrated on the controller 28. The electromagnetic proportional flow control valve 26 is gradually switched to a side of the output position 26*b* according to the amount of change in electric signal Pxz, and the pressure oil accumulated in the accumulator 27 variably flows through the oil passage 30, the check valve of the electromagnetic proportional flow control valve 26, and the oil passage 29 and is then joined to the oil passage 23, and is supplied to the bottom chamber 5A of the hydraulic cylinder. Thus, the pressure oil accumulated in the accumulator 27 is regenerated.

At the same time, the electric signal Pxz is input from the controller 28 through the electric signal line 41 to the solenoid unit 40-1 of the electromagnetic proportional flow control valve 40. The electromagnetic proportional flow control valve 40 is gradually switched to the switching position 40*b* according to the amount of change in electric signal Pxz, and an opening between the oil passage 12 and the oil passages 13 is variably gradually reduced, and an opening between the oil passages 12 and 42 is variably gradually increased. When the amount of change in electric signal Pxz is large and the electromagnetic proportional flow control valve 40 is completely switched to the switching position 40*b*, the communication between the oil passage 12 and the oil passage 13 is shut off, and the oil passage 12 is completely communicated with the tank 11 via the oil passage 42.

Here, the oil passage 12 of the main hydraulic pump 2 is branched into two systems of the oil passage 13 and the oil passage 42 by the electromagnetic proportional flow control valve 40, and an oil amount Q12 discharged from the oil passage 12 is variably divided into an oil amount Q13 of the oil passage 13 and an oil amount Q42 of the oil passage 42 to be output (Q12=Q13+Q42). An oil amount Q5A flowing into the bottom chamber 5A of the hydraulic cylinder 5 is the sum of an oil amount Q29 supplied from the accumulator 27 via the electromagnetic proportional flow control valve 26 to the oil passage 23, and an oil amount Q23 supplied from the main hydraulic pump 2 via the electromagnetic proportional flow control valve 40 and the directional switching valve 4 to the oil passage 23 (Q5A=Q29+Q23). Thus, the pressure oil of the oil amount Q29 is regenerated from the accumulator 27. The oil amount Q5A is the same as the amount of oil flowing into the bottom chamber 5A during the normal extension operation, and the oil amount Q29 and the oil amount Q42 are complementary to each other. That is, the electromagnetic proportional flow control valve 26 and the electromagnetic proportional flow control valve 40 have characteristics complementary to each other with respect to the amount of change in the electric signal Pxz. For example, the oil amount Q29 supplied from the accumulator 27 to the bottom chamber 5A is the same as the oil amount Q42 discharged from the oil passage 12 via the electromagnetic proportional flow control valve 40 to the oil passage 42 when the directional switching valve 4 is fully opened (i.e., Q29=Q42). That is, considering the amount of movement of the directional switching valve 4 according to the pressure Px corresponding to the amount of operation of the operating lever 6-1, Q29=Q42×f (Px) may be used. Here, f (Px) is a function of the pressure corresponding to the amount of operation of the operating lever 6-1, and is substantially proportional to the amount of operation and is 1 when the amount of operation exceeds a predetermined value. As a result, the characteristics curve of the relationship between the amount of operation of the lever and the rod speed during the regeneration operation has the same characteristics as that in FIG. 4 during the normal operation.

Referring to FIG. 8, the amount of change in electric signal Pxz output to the electromagnetic proportional flow control valve 26 is an amount ΔPx corresponding to only the pressure Px as in the case of retraction when the pressure Pz is equal to or more than the predetermined high value $P_H$, and is an amount ΔPz corresponding to only the pressure Pz when the pressure Pz is equal to or more than the predetermined low value $P_L$ and less than the predetermined high value $P_H$, and when the pressure Pz is less than the predetermined low value $P_L$, the amount is zero. That is, when the pressure accumulated in the accumulator 27 is high, the regeneration operation is performed, and when the pressure is low, the regeneration operation is not performed. When the pressure Pz is equal to or more than the predetermined low value $P_L$ and less than the predetermined high value $P_H$, which is a moderate pressure, the percentage of the regeneration oil amount Q29 supplied from the accumulator 27 is set to be lower than that when the pressure Pz is equal to or more than the predetermined high value $P_H$. Thus, even when the pressure accumulated in the accumulator 27 is relatively low, regeneration can be performed, which is excellent in energy efficiency. Regeneration may be performed only when the pressure in the accumulator 27 is equal to or more than the predetermined high value $P_H$. Thus, the control of the electromagnetic proportional flow control valves 26 and 40 can be simplified.

Arranging the electromagnetic proportional flow control valve 40, which is controlled by the electric signal from the controller, between the oil passage 12 and the oil passage 13, causes the pressure oil accumulated in the accumulator 27 to be regenerated via the electromagnetic proportional flow control valve 26 to the bottom chamber 5A of the hydraulic cylinder 5 while using the fixed displacement type main hydraulic pump 2, and at the same time, causes the oil discharged from the main hydraulic pump 2 to be communicated with the low pressure tank 11 by the electromagnetic proportional flow control valve 40, thereby reducing the discharge pressure of the main hydraulic pump 2. The relationship between a pump output E, a pump discharge pressure P, and a discharge flow rate Q is as follows:

$$E \propto P \times Q$$

Therefore, the output (load) of the main hydraulic pump 2 is reduced, which allows energy saving of the system to be achieved.

Further, by adding the accumulator 27, the electromagnetic proportional flow control valves 26, 40, etc. to a hydraulic circuit including a fixed displacement type main hydraulic pump, which has been frequently used, a regeneration function can be easily added at low cost.

As described above, the embodiments according to the present invention have been described with reference to the drawings. However, the specific configuration is not limited to these embodiments, and any changes and additions without departing from the scope of the present invention are included in the present invention.

For example, the case has been described in which part of the return oil from the bottom chamber 5A is accumulated in the accumulator 27 when the rod 5*a* is retracted, and the accumulated pressure oil is regenerated to the bottom chamber 5A when the rod 5*a* is extended. However, part of the return oil from the rod chamber 5B may be accumulated in the accumulator 27 when the rod 5*a* is extended. Furthermore, part of the return oil from the bottom chamber 5A and the rod chamber 5B may be accumulated in the accumulator 27 both when the rod 5*a* is retracted and when the rod 5*a* is extended.

Further, the fluid pressure actuator may be other than a hydraulic cylinder. The present invention can be applied to any circuit that accumulates oil in an accumulator and regenerates the accumulated oil in a hydraulic circuit including a fixed displacement type main hydraulic pump, for example, that accumulates part of the return oil at the time of braking of a hydraulic motor in the accumulator, and regenerates the accumulated pressure oil at the time of acceleration of the hydraulic motor.

Further, the case in which oil is used as fluid has been described as an example, however the present invention can be applied to any fluid such as water or air.

Further, the electromagnetic proportional flow control valves 26 and 40 are not limited to have the configuration in which the switching operation is performed by electricity, but may be hydraulically operated valves.

Further, the function of the electromagnetic proportional flow control valve 40 may be incorporated in the directional switching valve 4. In this case, it is preferable that the directional switching valve 4 be controlled by both a pilot oil pressure and an electric signal.

REFERENCE SIGNS LIST

2 Main hydraulic pump (fixed displacement pump)
4 Directional switching valve
5 Hydraulic cylinder (fluid pressure actuator)
5A Bottom chamber
5B Rod chamber

5*a* Rod
6 Remote control valve
6-1 Operating lever
11 Tank
23 Oil passage (connection flow passage)
26 Electromagnetic proportional flow control valve (accumulator flow control valve)
27 Accumulator
28 Controller
29, 30 Oil passage (branch flow passage)
33 Pressure sensor
40 Electromagnetic proportional flow control valve (pump flow control valve)
130 Hydraulic circuit (fluid pressure circuit)

The invention claimed is:

1. A fluid pressure circuit comprising:
a tank having a fluid stored therein;
a fixed displacement pump configured to pressurize the fluid in the tank to generate a pressurized fluid;
a fluid pressure actuator configured to be driven by the pressurized fluid discharged from the fixed displacement pump and to be controlled in accordance with an operation command;
a directional switching valve arranged between the fixed displacement pump and the fluid pressure actuator and configured to switch flow passages for the pressurized fluid;
an accumulator arranged in a branch flow passage branched from a connection flow passage that connects the fluid pressure actuator and the directional switching valve;
an accumulator flow control valve arranged in the branch flow passage between the connection flow passage and the accumulator; and
a pump flow control valve arranged between the fluid pressure actuator and the fixed displacement pump and configured to diverge the pressurized fluid supplied from the fixed displacement pump into two systems consisting of a first system including the tank and a second system including the fluid pressure actuator and to gradually vary flow rates of the pressurized fluid supplied to the first system and the second system in accordance with an electric control signal sent to the pump flow control valve.

2. The fluid pressure circuit according to claim 1, wherein the pump flow control valve is a spool valve.

3. The fluid pressure circuit according to claim 2, comprising a control unit configured to relevantly control the pump flow control valve when the fluid pressure actuator is operated by the accumulator.

4. The fluid pressure circuit according to claim 3, wherein the accumulator flow control valve is a proportional valve configured to variably control a flow rate, and the control unit outputs a complementary operation command to the accumulator flow control valve and the pump flow control valve.

5. The fluid pressure circuit according to claim 4, further comprising a sensor configured to detect a pressure of the fluid in the accumulator.

6. The fluid pressure circuit according to claim 4, wherein the pump flow control valve is arranged between the directional switching valve and the fixed displacement pump.

7. The fluid pressure circuit according to claim 3, further comprising a sensor configured to detect a pressure of the fluid in the accumulator.

8. The fluid pressure circuit according to claim 3, wherein the pump flow control valve is arranged between the directional switching valve and the fixed displacement pump.

9. The fluid pressure circuit according to claim 2, further comprising a sensor configured to detect a pressure of the fluid in the accumulator.

10. The fluid pressure circuit according to claim 2, wherein
the pump flow control valve is arranged between the directional switching valve and the fixed displacement pump.

11. The fluid pressure circuit according to claim 1, comprising a control unit configured to relevantly control the pump flow control valve when the fluid pressure actuator is operated by the accumulator.

12. The fluid pressure circuit according to claim 11, wherein
the accumulator flow control valve is a proportional valve configured to variably control a flow rate, and the control unit outputs a complementary operation command to the accumulator flow control valve and the pump flow control valve.

13. The fluid pressure circuit according to claim 12, further comprising a sensor configured to detect a pressure of the fluid in the accumulator.

14. The fluid pressure circuit according to claim 12, wherein
the pump flow control valve is arranged between the directional switching valve and the fixed displacement pump.

15. The fluid pressure circuit according to claim 11, further comprising a sensor configured to detect a pressure of the fluid in the accumulator.

16. The fluid pressure circuit according to claim 11, wherein
the pump flow control valve is arranged between the directional switching valve and the fixed displacement pump.

17. The fluid pressure circuit according to claim 1, further comprising a sensor configured to detect a pressure of the fluid in the accumulator.

18. The fluid pressure circuit according to claim 17, wherein
the pump flow control valve is arranged between the directional switching valve and the fixed displacement pump.

19. The fluid pressure circuit according to claim 1, wherein
the pump flow control valve is arranged between the directional switching valve and the fixed displacement pump.

* * * * *